US006807692B2

(12) United States Patent
Tsutsui et al.

(10) Patent No.: US 6,807,692 B2
(45) Date of Patent: Oct. 26, 2004

(54) WATER LOCK TAP

(75) Inventors: Hidetaka Tsutsui, Tokyo-To (JP); Makoto Kodaira, Tokyo-To (JP); Noboru Nakajima, Tokyo-To (JP)

(73) Assignee: Uro Denshi Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/769,847

(22) Filed: Feb. 3, 2004

(65) Prior Publication Data

US 2004/0154096 A1 Aug. 12, 2004

Related U.S. Application Data

(62) Division of application No. 10/175,296, filed on Jun. 20, 2002, now abandoned.

(30) Foreign Application Priority Data

May 1, 2002 (JP) ..... 2002-129660

(51) Int. Cl.[7] ..... E03C 1/042

(52) U.S. Cl. ..... 4/695; 4/675; 137/359; 137/801; 285/208

(58) Field of Search ..... 4/675–678, 695; 137/359, 360, 801; 285/64, 208

(56) References Cited

U.S. PATENT DOCUMENTS

| | | | | |
|---|---|---|---|---|
| 4,281,857 A | | 8/1981 | Randall | 4/695 |
| 4,852,192 A | | 8/1989 | Viegener | 4/695 |
| 5,465,749 A | | 11/1995 | Sauter et al. | 4/675 |
| 5,884,662 A | | 3/1999 | Ko | 137/801 |
| 5,946,746 A | | 9/1999 | Bloom | 4/675 |
| 6,006,784 A | | 12/1999 | Tsutsui et al. | 137/801 |
| 6,328,059 B1 | * | 12/2001 | Testori et al. | 137/315.12 |
| 6,385,798 B1 | * | 5/2002 | Burns et al. | 4/675 |
| 6,421,849 B1 | * | 7/2002 | Gray | 4/675 |
| 6,571,407 B1 | | 6/2003 | Skarie | 4/695 |

FOREIGN PATENT DOCUMENTS

| | | |
|---|---|---|
| JP | 2000-144830 | 5/2000 |

* cited by examiner

*Primary Examiner*—Tuan Nguyen
(74) *Attorney, Agent, or Firm*—Jacobson Holman PLLC

(57) ABSTRACT

A water lock tap comprises a pedestal, which is secured to an attachment object such as a washstand, a pipe attachment member for attaching a water supply pipe to the bottom of the pedestal, and a neck, which is secured to the pedestal; the pedestal comprises a mesh structure for securing the neck to the outer periphery of the pedestal, and having a ring-like blade section which clips into an attachment hole, provided in the attachment object, and a cylindrical moving member which is suspended from the ring-like blade section and has a plurality of protruding members, which are pressed toward the outside when a cylindrical member having a screw notch in its outer periphery is screwed into a cylindrical space having a screw notch in its inner periphery. The pipe member comprises a flange section that connects to the screw notch section and is accommodated in the ring-like blade, and a joint section that is connected to the water supply pipe.

6 Claims, 13 Drawing Sheets

WATER LOCK TAP

This is a division of application Ser. No. 10/175,296, filed Jan. 20, 2002, now abandoned.

BACKGROUND OF THE INVENTION

1. Field of the Invention

The present invention relates to a flush tap provided on a washstand and the like, and more particularly to one which is attached from above the washstand and the like.

2. Description of the Related Art

In attaching a flush tap to, for example, a washstand, a pedestal is secured to the washstand, a water supply pipe is secured below the pedestal, and a neck is attached above the pedestal. Then, the water supply pipe is attached at the back of the washstand, and the neck is attached above the washstand.

Some necks can be attached by a single process, and selecting such a neck simplifies-the attachment operation. In contrast, most pedestals are extremely tiresome to attach.

The pedestal is attached to the washstand by screwing from the back thereof. Since washstands are usually attached to a wall, there is very little space at the back, making this a difficult operation. For this reason, it often takes a long time to secure the screw. In addition, since a water supply pipe must also be connected, the work at the back of the washstand requires a great deal of time.

A water lock is provided to a washstand and the like, and at the time of installation it must be connected to the water supply pipe below the washstand; this structure has poor workability.

FIG. 13 shows the installation structure of a neck in a conventional water lock tap. The neck comprises a neck main body 2 having a flooding exit 1; a knob 3 is provided at the top, and a water supply section 4 having a screw cut in its periphery is provided at the bottom. The water supply section 4 is inserted through a metal washer 5, and is secured to an unillustrated washstand by a nut 6.

In this case, the nut 6 with the metal washer 5 inserted must be tightened using tools below the washstand, and the person who performs this operation must squeeze himself into a narrow space, making the workability extremely poor.

Consequently, there is a demand for a water lock which can be easily installed, and this has led to the use of separate structures for the neck and the pedestal section, which is attached to the washstand and supports the neck. This configuration enables the operations of attaching the pedestal section to the washstand, and attaching the neck to the pedestal section, to be separated, thereby improving the workability. A one-touch neck which can easily be attached and removed has already been provided.

However, water lock work involves not only the neck but also its pedestal, and if the pedestal cannot easily be attached and removed there is no benefit. In attempting to simplify the attachment and removal of the neck while also facilitating the attachment of the pedestal, the attachment and removal of the neck must be simplified without any great effect on the structure of the pedestal, and in particular the section where the neck is attached.

However, the conventional one-touch neck uses a screw system, and inevitably requires a rotational force to be applied to the pedestal during installation; when the pedestal has a lock nut system, the rotational force of the neck rotates the pedestal itself. As a result, the pedestal must have a special structure which can withstand this rotational force at the time of attaching the neck, requiring the entire constitution, including the pedestal, to be changed.

SUMMARY OF THE INVENTION

It is an object of the present invention to provide a flush tap wherein the pedestal can be attached on top of the washstand and the like.

It is another object of the present invention to provide a water lock wherein the neck can be easily attached to the pedestal without requiring a pedestal of special structure.

In order to achieve the above objects, the water lock tap of this invention comprises a pedestal, which is secured to an attachment object such as a washstand, a pipe attachment member for attaching a water supply pipe to the bottom of the pedestal, and a neck, which is secured to the pedestal. The pedestal comprises a mesh structure for securing the neck to the outer periphery of the pedestal, and having a ring-like blade section which clips into an attachment hole, provided in the attachment object, and a cylindrical moving member which is suspended from the ring-like blade section and has a plurality of protruding members, which are pressed toward the outside when a cylindrical member having a screw notch in its outer periphery is screwed into a cylindrical space having a screw notch in its inner periphery, the cylindrical member having a slightly smaller diameter than the cylindrical space. The pipe attachment member comprises a screw notch section which functions as the cylindrical member, a flange section which connects to the screw notch section and is accommodated in the ring-like blade section in the pedestal, and a join section which is connected to the water supply pipe.

The present invention further provides a one-touch attachment water lock comprising a pedestal, which is secured to an attachment object such as a washstand, a pipe-connecting member for attaching a water supply pipe and supported by the pedestal, and a neck, which is secured to the pedestal. A plurality of spiraled grooves for securing the neck are provided in the outer periphery of pedestal, and a clawed member, which meshes into the spiraled grooves, is provided on the inner periphery of the base of the neck.

PREFERRED EMBODIMENT

Figure 1:
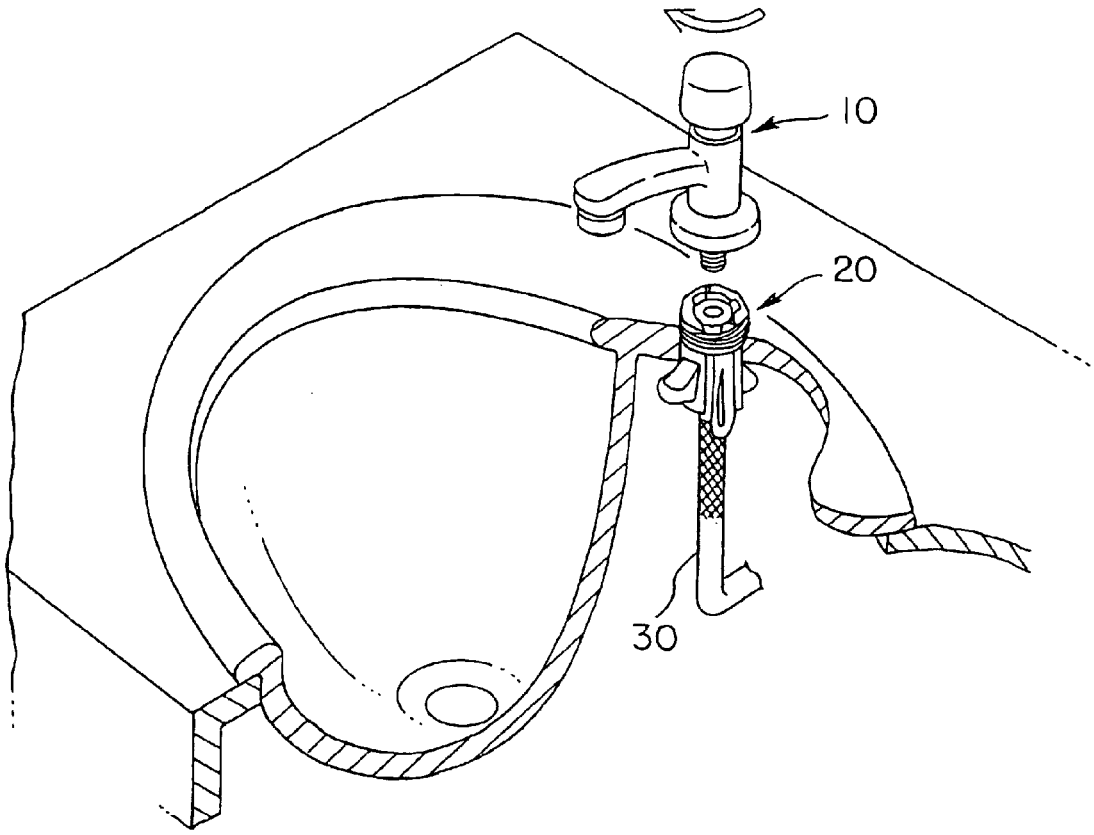
FIG. 1 shows the schematic constitution of an embodiment of this invention.

FIG. 1 is a view of the final stage of attaching a flush tap according to the present invention, and shows the state when a neck is attached to a pedestal, which is already attached to a washstand.

The neck 10 has a screw structure such that it is secured to the pedestal by being rotated by, for example, approximately 60 degrees, as shown by the arrow; for this purpose, a screw groove is cut around the pedestal 20. Three protruding members are provided below the pedestal 20, and project in the direction of its perimeter when an operation to connect the water supply pipe is executed from above the washstand, as explained later; the protruding members directly contact installation holes in the washstand and thereby secure it to the pedestal 20.

It is easy to prevent the neck 10 and the pedestal 20 from becoming removed, by inserting an unillustrated securing pin into a securing pin hole 25.

A water supply pipe 30 is secured beforehand to the pedestal 20 by a water attachment member 30, and is inserted through a hole for attaching the pedestal 20 of the washstand at the time of attaching the pedestal 20. After completion of the attachment of the pedestal 20 and prior to attaching the neck 10, the bottom end of the water supply pipe is connected to a main water pipe.

Figure 2:
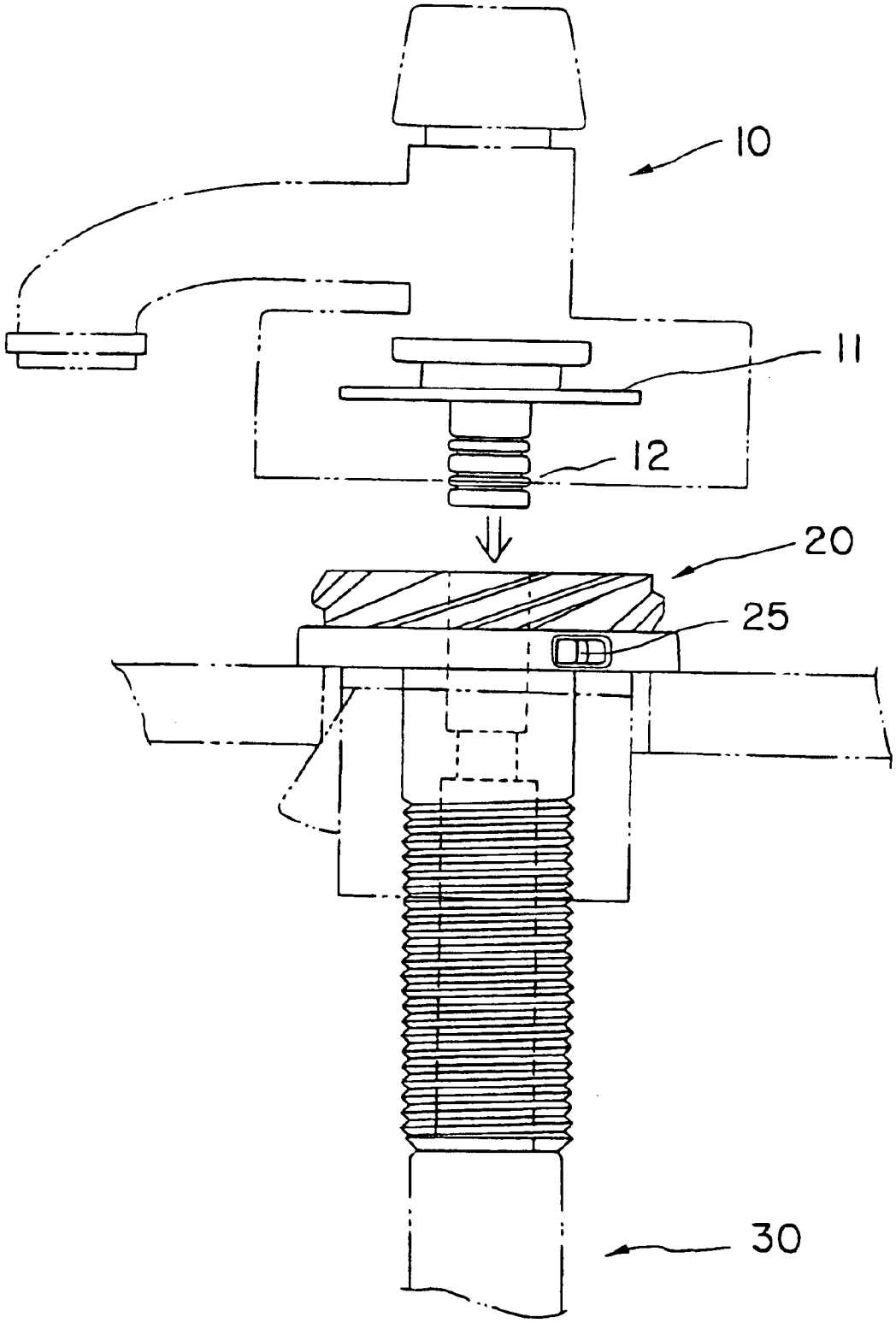
FIG. 2 shows a side view of a step of attaching a neck 10 to a pedestal 20, as in FIG. 1.

FIG. 2 shows the a side view of the same state as shown in FIG. 1, where the neck 10 is about to be attached to the pedestal 20. After the pedestal 20 has been attached to the washstand, an insertion hole 12, which extends downwards in the diagram from the center of a flange 11, provided at the bottom part of the neck 10, is inserted into the center of the pedestal 20, and an unillustrated screw, provided around the lower inside periphery of the neck 10 is screwed into a screw groove provided around the pedestal 20, thereby securing the neck 10.

Since the water supply pipe 30 is already attached to the pedestal 20, water can be supplied after the neck 10 has been inserted by connecting the unillustrated bottom end of the water attachment member 30 to the main water pipe.

Figure 3C:
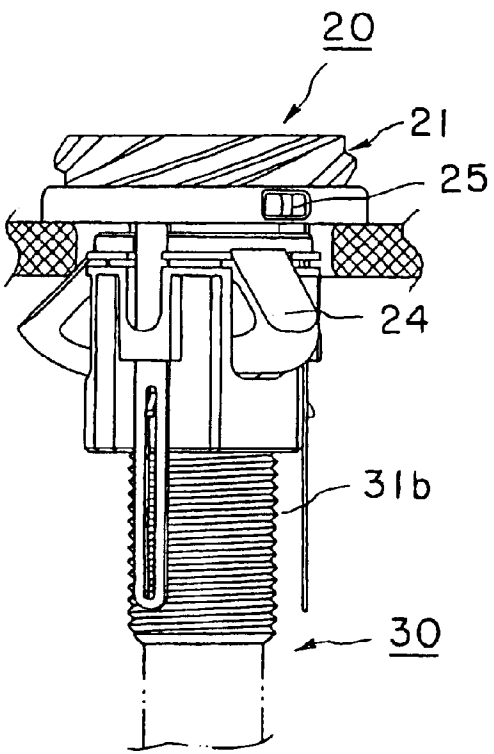
FIGS. 3A, 3B, and 3C show consecutive steps of attaching the pedestal 20 and a water supply pipe 30 to a washstand.
Figure 3B:
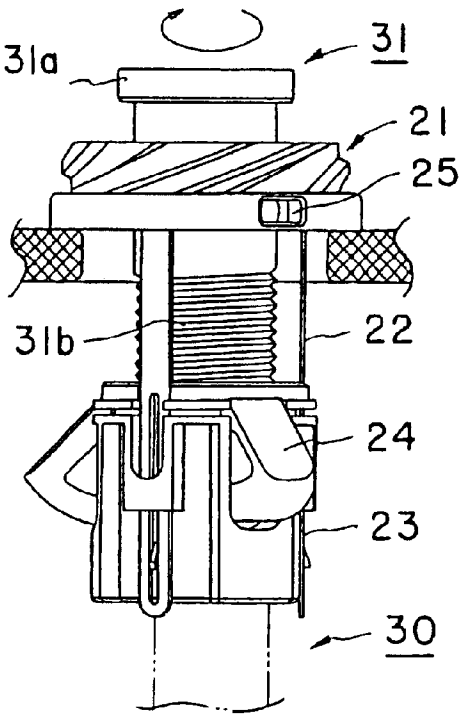
Figure 3A:
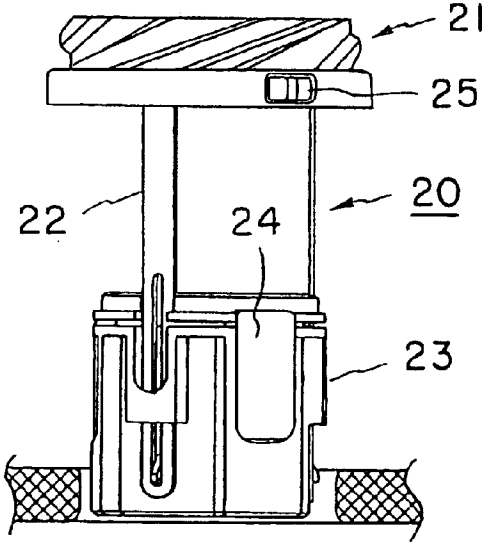

FIGS. 3A to 3C show three stages of attaching the pedestal 20 and the water attachment member 30 to the washstand. Firstly, FIG. 3A shows the pedestal 20 being fitted into the attachment hole of the washstand. As shown in FIG. 3A, the pedestal 20 comprises a ring-like blade section 21 on the top face of the washstand, and a substantially cylindrical moving member 23 which is suspended from the ring-like blade section 21 by three suspending members 22; the moving member 23 supports three protruding members 24 so that they can sway freely.

In attaching the pedestal 20 into the attachment hole of the washstand, the moving member 23 is inserted into the attachment hole without allowing the protruding members 24 to snag in the attachment hole, and the ring-like blade section 21 is lowered until it directly contacts the top face of the washstand.

Then, a pipe attachment member 30, which the water supply pipe is attached to, is inserted into holes near the centers of the ring-like blade section 21 and the moving member 23 of the pedestal 20. The water supply pipe should have a diameter which is appropriate for passing through these holes. The moving member 23 has a screw cut into the inner face of its hole, and screws into a screw notch 31*b*, provided in the outer periphery of the pipe attachment member 30.

FIG. 3B shows the stage where the water attachment member 30 has been inserted a certain distance into the moving member 23; when a flange section 31*a* is rotated in the direction of the arrow shown in the diagram, the outer periphery of the water attachment member 30 presses the protruding members 24 of the moving member 23 outwards. When the flange section 31*a* is rotated further, the moving member 23 moves upwards with its protruding members 24 still pressed outwards.

FIG. 3C shows the stage where the moving member 23 has stopped moving, and the pedestal 20 is secured to the washstand. The pedestal 20 is secured to the washstand when the ring-like blade section 21 directly contacts the top face of the washstand and the protruding members 24 directly contact the bottom faces of the attachment holes. In the final stage of this securing operation, the direction of the pedestal 20 is confirmed and the pedestal 20 is tightened using a hexagonal wrench. The direction of the pedestal 20 is selected as appropriate to enable the neck to be attached.

Figure 4A:
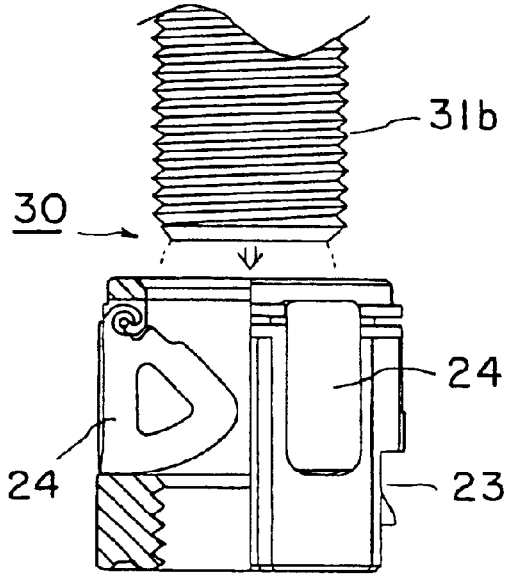
FIGS. 4A, 4B, and 4C show the cooperative relationship between a moving member 23, protruding members 24, and a screw notch 31*b* of a pipe attachment member 30, with the moving member 23 shown in cross-section.
Figure 4B:
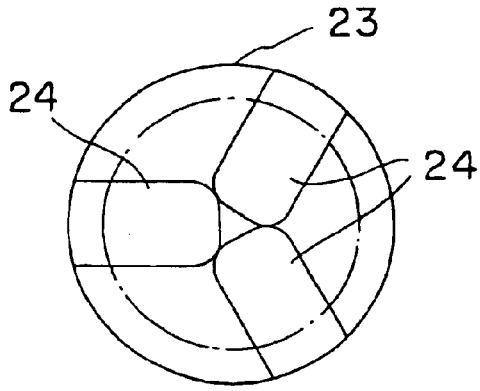
Figure 4C:
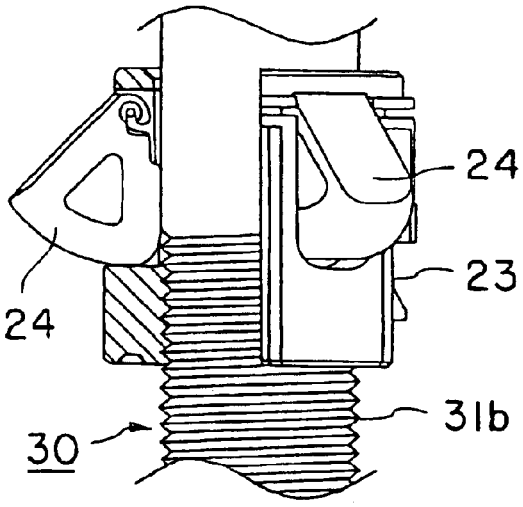

FIGS. 4A to 4C are cross-sectional views of the moving member 23, showing the cooperative relationship between the moving member 23, the protruding members 24, and the screw notch 31*b* of the water attachment member 30. The side faces of the primary sections of the protruding members 24 are fan-shaped and face upwards, the fan-shaped primary parts forming fulcrums near the outer periphery of the moving member 23, thereby supporting the protruding members 24 so that they can sway freely.

As shown in FIG. 4A, prior to inserting the water attachment member 30 into the hole in the moving member 23, the protruding members 24 can be retracted from the outer periphery of the moving member 23. FIG. 4B is a view of the three protruding members 24 from below the moving member 23 at this time, and illustrates how the three protruding members 24 can directly contact each other inside the hole of the moving member 23.

Next, when the screw notch 31*b* of the water attachment member 30 is screwed into the moving member 23, the protruding members 24 cannot enter the hole of the moving member 23 and are pressed outwards, reaching the outwardly protruding state shown in FIG. 4C.

Figure 5A:
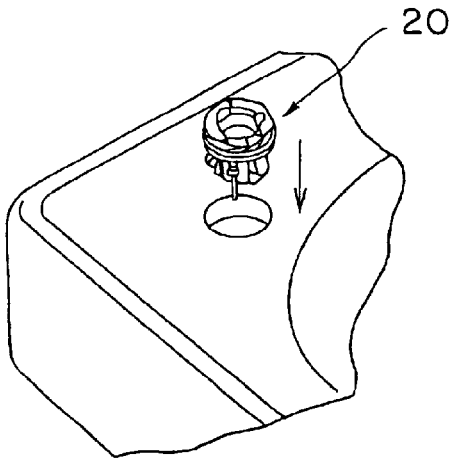
FIGS. 5A, 5B, and 5C show consecutive steps of attaching the pedestal 20 and the pipe attachment member 30 to the washstand.
Figure 5B:
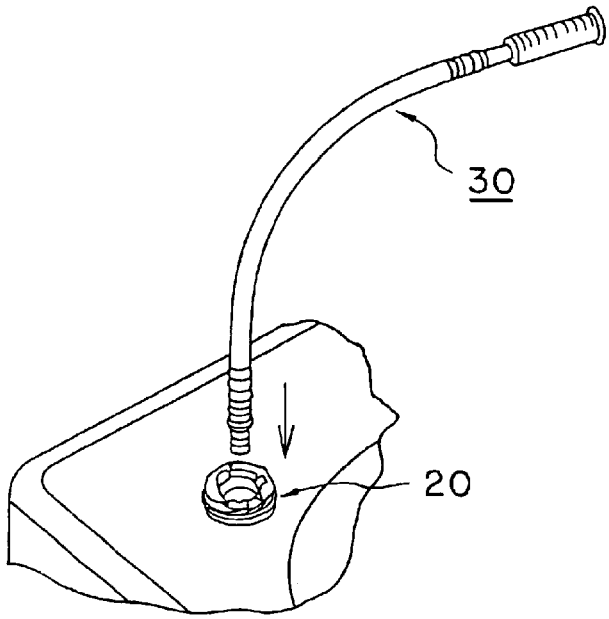
Figure 5C:
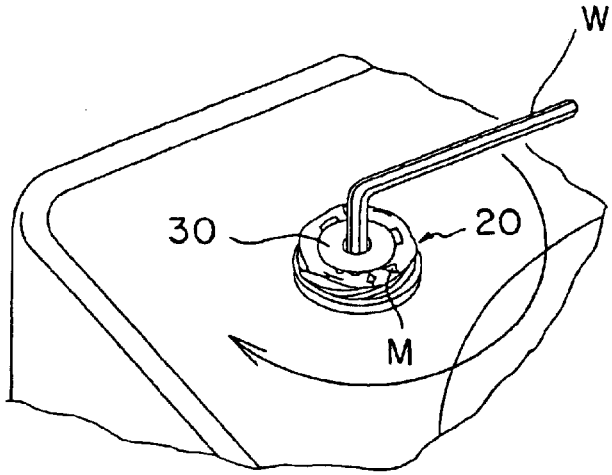

FIGS. 5A to 5C follow the stages of attaching the pedestal 20 and the water attachment member 30 to the washstand. FIG. 5A shows the bottom section of the pedestal 20, which has been inserted into the washstand. FIG. 5B shows the water attachment member 30, which a flexible tube has been attached to, prior to its insertion into the hole in the pedestal 20. FIG. 5C shows the final stage of attaching the water attachment member 30, when a wrench W is used to tighten the water attachment member 30. At this time, a mark M, provided on the pedestal 20, is pointed in a predetermined direction, and final tightening is performed using the wrench. The mark M shows the direction of the neck when installed.

Figure 6A:
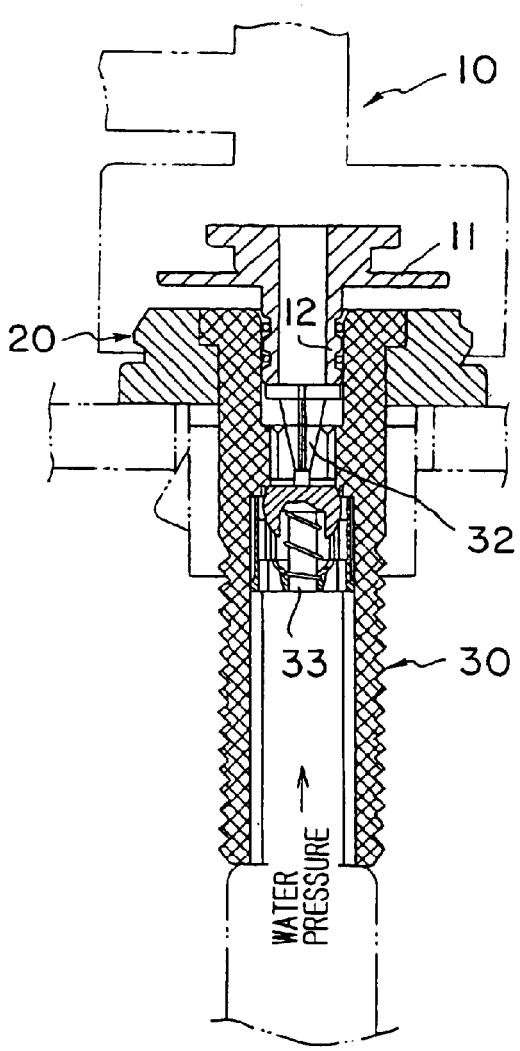
FIGS. 6A and 6B show a water-stop valve, provided inside the water attachment member 30 and opened when attaching the neck 10 after the pedestal 20 and the water attachment member 30 have been attached to the washstand.
Figure 6B:
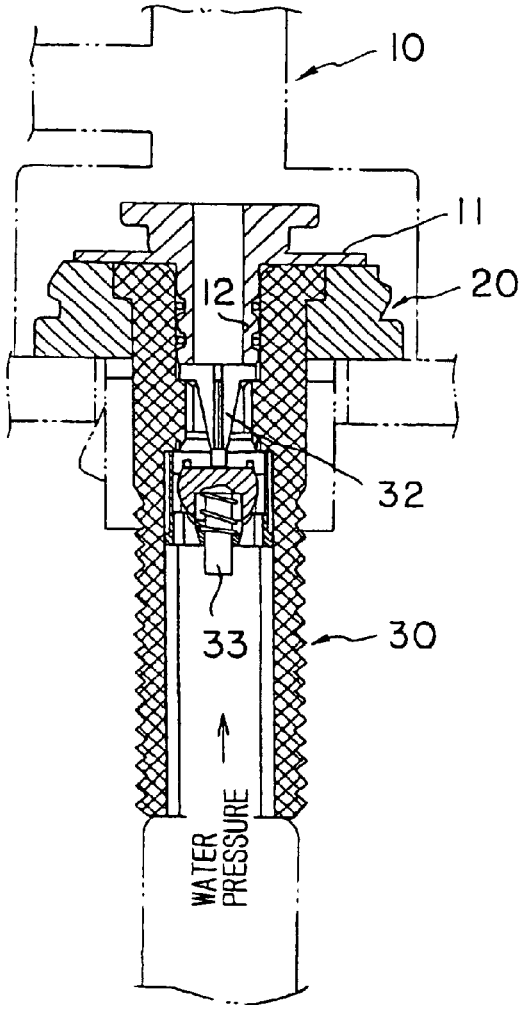

FIGS. 6A and 6B show how a dead water valve, provided in the water attachment member 30, is opened while attaching the neck 10 after the pedestal 20 and the water attachment member 30 have been installed to the washstand.

FIG. 6A shows the state when the neck 10 has been inserted a certain distance through the hole in the pedestal 20 and the water attachment member 30, and FIG. 6B shows the state when the neck 10 is completely inserted. In FIG. 6A, there is a space between the strike face 11 in the contact metal fitting of the neck 10 and the top face of the pedestal 20, and the insertion hole 12 of the contact metal fitting of the neck 10 at this time starts to touch the dead water valve control stick 32 in the water attachment member 30. Then, in FIG. 6B, as a result-of completely inserting the neck 10, the insertion hole 12 of the contact metal fitting presses against the dead water valve control stick 32, whereby the valve body 33 drops, allowing water to pass through the area around the valve body 33. As a consequence, water is released from the tap.

Figure 7:
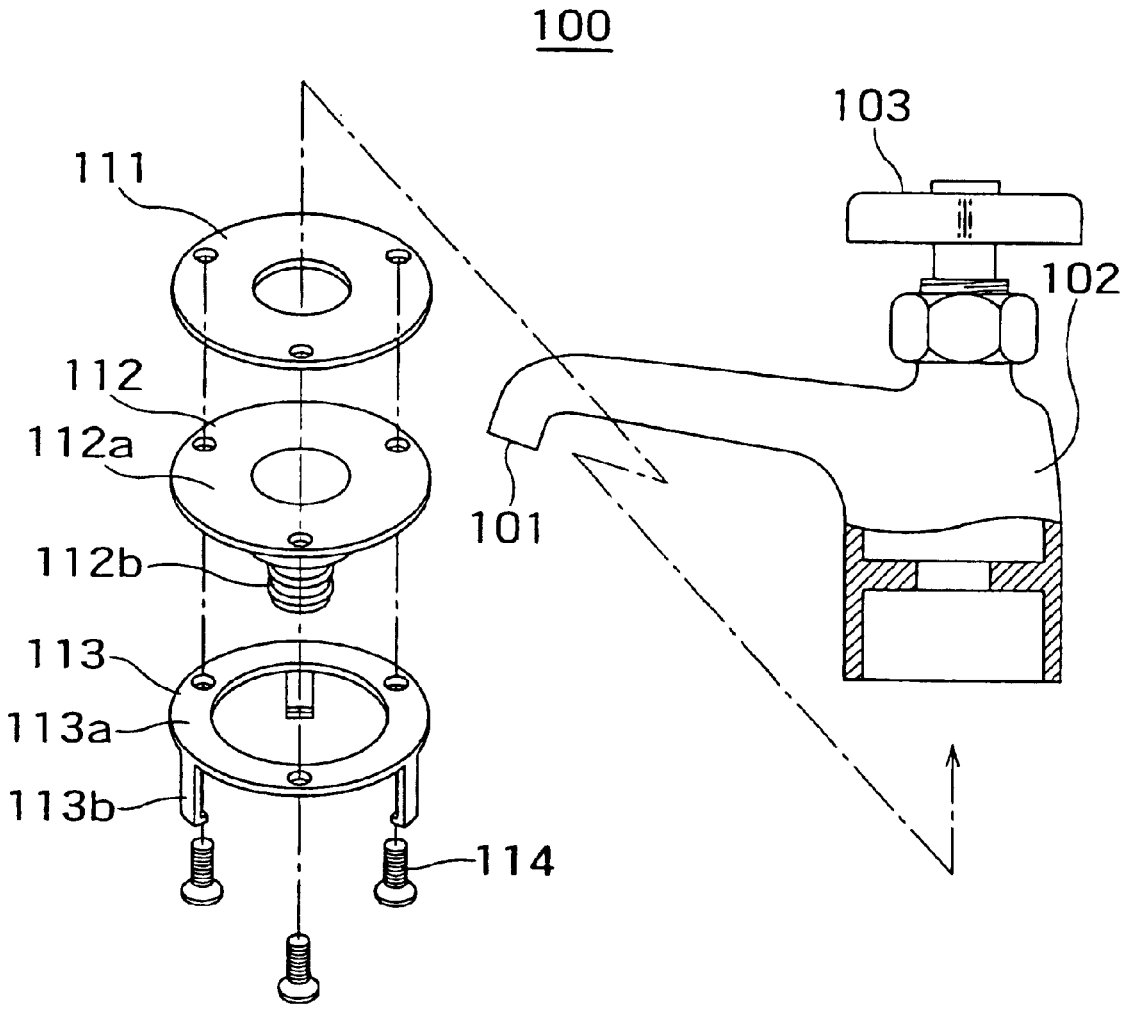
FIG. 7 shows the constitution of an embodiment of this invention.

FIG. 7 is an exploded view of one part of the attachment structure in the embodiment of this invention, and shows the structure of the neck side. In FIG. 7, a washer 111, a water-pass member 112, and a clawed member 113, are secured to the neck 100 by a bolt 114, and the neck 100 is secured to the pedestal when the clawed member 113 clips into the pedestal, as described later.

The neck 100 has a flooding hole 101, a main body 102, and a knob 103; the washer 111, the water-pass member 112, and the clawed member 113 are secured to the water supply section of the main body 102 by the bolt 114.

The washer 111 and the water-pass member 112 are secured together with the clawed member 113 to the inner periphery of the bottom section of the neck 100 by the bolt 114, thereby securing the flange section 112*a* of the water-pass member 112 to the water supply section of the neck 100 with the washer 111 therebetween, and fixing a connecting section 112*b* in a single piece with the neck 100. Furthermore, clawed leg sections 113*b* extend downwards at right angles from the outer edge of a ring-like section 113*a* of the clawed member 113, and substantially contact the inner wall of the bottom section of the neck 100.

Figure 8:
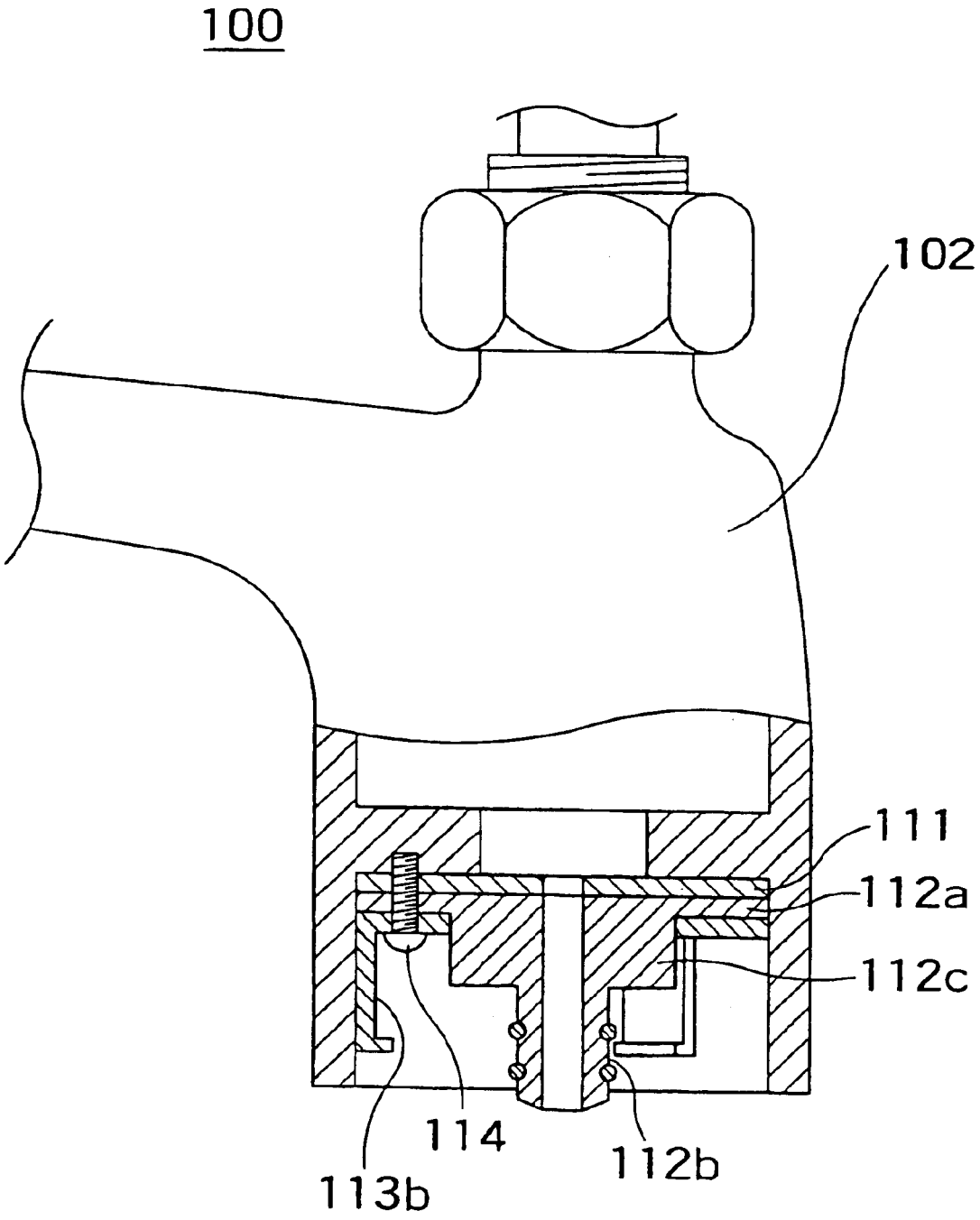
FIG. 8 shows a partially cross-sectional view of the assembled embodiment shown in FIG. 7.

FIG. 8 is a partial cross-sectional view of the state when the washer 111, the water-pass member 112, and the clawed member 113, are secured by the bolt 114 to the neck 100.

As shown in FIG. 8, when the washer 111, the water-pass member 112, and the clawed member 113, are secured to the neck 100 by the bolt 114, the water-pass member 112 connects directly with the water supply section of the neck 100, and a water-pass path is formed when the connecting section 112*b* is subsequently inserted into an unillustrated pipe-connecting member.

The claws of the clawed member 113 face inwards and contact the inner wall of the bottom face of the neck 100, the neck 100 being secured to the pedestal when the clawed member 113 clips into the pedestal, which is structured so as to correspond to the clawed member 113.

Figure 9:
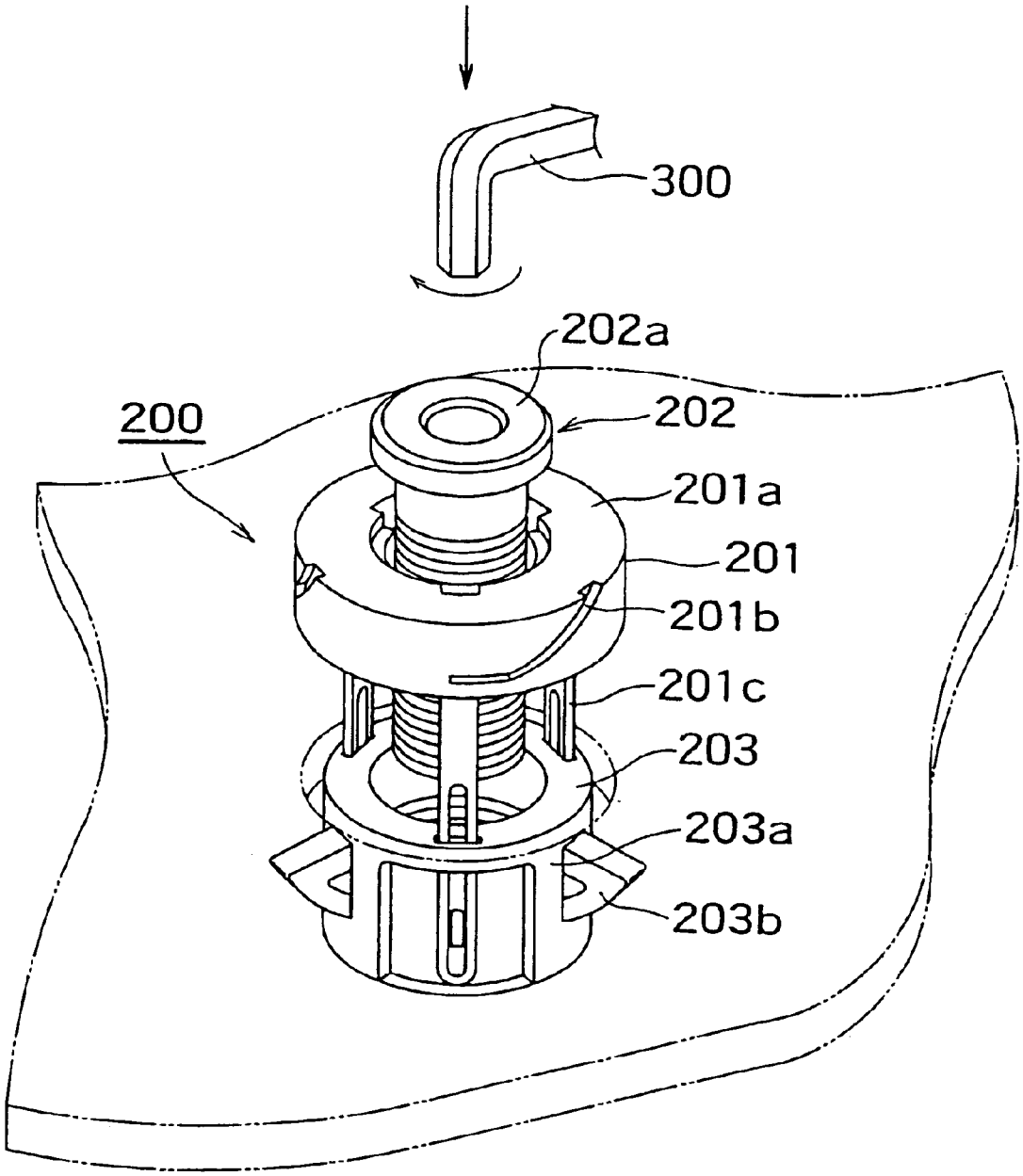
FIG. 9 shows an exploded view of a pedestal which is attached in the embodiment of FIG. 7.

FIG. 9 is an exploded view of a pedestal 200 which securely supports the neck 100 (shown in FIGS. 7 and 8). The pedestal 200 comprises a ring-like blade section 201, a pipe-connecting member 202, and a moving member 203 which is suspended from the ring-like blade member 201.

These components are attached to the washstand 400 and support the neck 100, while providing a water supply path for the neck 100. That is, the ring-like blade section 201 is provided on the top face of the attachment hole position of the washstand 400, a pipe-connecting member 202 is inserted into a hole in the center, and a screw thread, provided around the periphery of the pipe-connecting member 202, screws into a screw groove, provided in the inner periphery of the moving member 203, thereby moving the moving member 203 toward the bottom face of the washstand 400, which becomes squeezed between the ring-like blade section 201 and the moving member 203.

The ring-like blade section 201 comprises a substantially ring-shaped main body 201*a*, which has a larger outer diameter than the diameter of the water lock attachment hole provided in the washstand 400 and a slightly smaller inner diameter. The claws of the clawed member 113 (FIGS. 7 and 8) mesh into spiraled grooves 201*b*, provided in the, outer peripheral face of the main body 201*a*. In the case shown in FIG. 9, the spiraled grooves 201*b* are provided at equal intervals at three positions in the peripheral direction (at intervals of 120 degrees).

A flange section 202*a* at the top of the pipe-connecting member 202 is held in place by a step, provided in the inner periphery of the ring-like blade section 201; this step also secures the tops of the suspended members 201*c*. The suspended members 201*c* comprise thin metal plates, and have long holes at their lower ends (as shown in FIG. 9) for supporting the moving member 203 so that it can move. The top ends of the suspended members 201*c* are secured in the inner periphery of the ring-like blade section 201, and the long holes in their bottom ends mesh with protrusions provided on the outer periphery of the moving member 203.

The moving member, suspended below the ring-like blade section 201, is substantially cylindrical, and has a screw groove on its inner periphery for screwing the screw thread of the pipe-connecting member 202. When the pipe-connecting member 202 is screwed in using a hexagonal wrench or the like, the moving member 203 moves in the upward direction of FIG. 9, and when the pipe-connecting member 202 is loosened, the moving member 203 moves in the downward direction.

Three vertical through-holes are provided in the wall of the moving member 203, and protruding members 203*b* are attached through the through-holes so as to freely sway. The side-walls of the protruding members 203*b* are fan-shaped, and are attached into the through-holes of the moving member 203 with their fulcrums near the top-points of the holes, enabling them to swing in and out of the outer peripheral wall of the moving member 203.

In FIG. 9, the protruding members 203*b* are shown protruding from the moving member 203, but they sway freely and can be pressed inside. On the other hand, when the pipe-connecting member 202 is screwed into the moving member 203, the protruding members 203*b* are pressed outward by the outer peripheral face of the pipe-connecting member 202 so that they protrude from the outer peripheral face of the moving member 203.

Figure 10A:
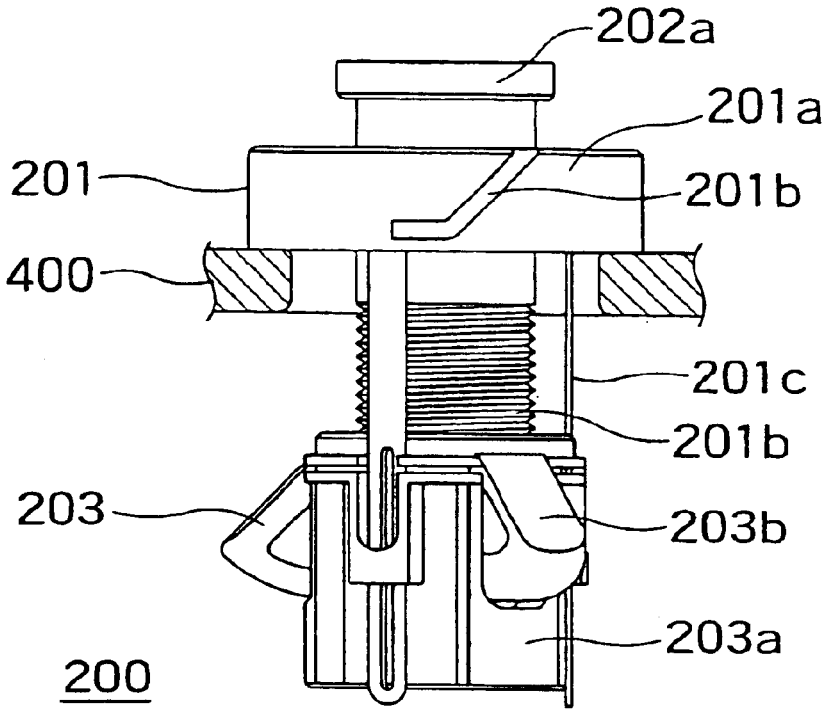
FIG. 10A shows a diagram showing a state midway during attachment to the pedestal in FIG. 9.
Figure 10B:
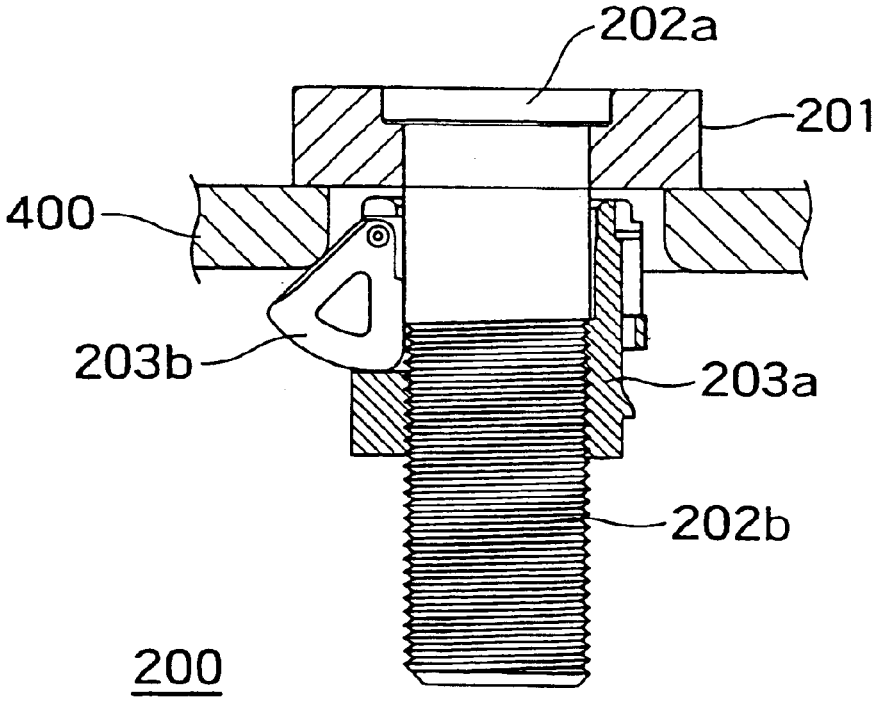
FIG. 10B shows a diagram showing the state after attachment has been completed.

FIGS. 10A and 10B show the process of attaching the pedestal 200 to the washstand 400, FIG. 10A showing the pipe-connecting member 202 screwed a certain distance into the moving member 203, and FIG. 10B showing the pipe-connecting member 202 completely screwed in.

In FIG. 10A, the top section of the pipe-connecting member 202 sticks out slightly from the ring-like blade section 201, so that the bottom of the outer peripheral face of the pipe-connecting member 202 directly contacts the protruding members 203*b* and pushes them out from the outer peripheral face of the moving member 203. In the stage prior to this, the protruding members 203*b* are pressed while placing the ring-like blade section 201 into the attachment hole of the washstand 400, and the pipe-connecting member 202 is inserted and screwed into the screw groove of the moving member 203, thereby reaching the state shown in FIG. 10A.

FIG. 10B shows the state reached when the pipe-connecting member 202 is screwed in further, so that the bottom of the pipe-connecting member 202 protrudes greatly from the bottom end of the moving member 203. At this time, the protruding members 203*b* are directly contacting the bottom end of the attachment hole in the washstand 400, and the moving member 203 has moved as high as it can possibly move. The constituent material of the washstand 400 is tightly squeezed between the bottom face of the ring-like blade section 201 and the outside faces of the protruding members 203*b*, securing the pedestal 200 to the washstand 400.

Figure 11:
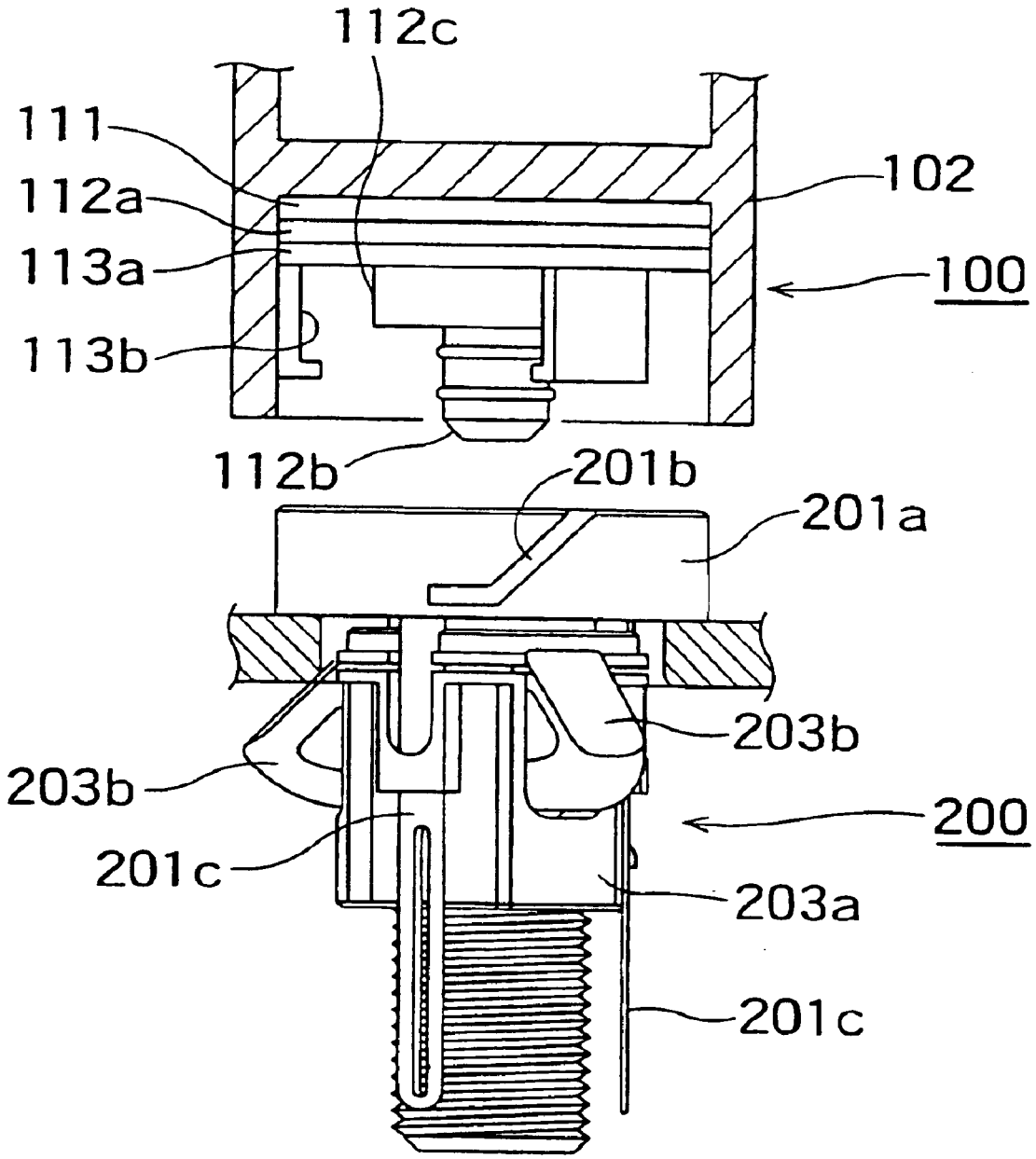
FIG. 11 shows a diagram showing the neck in the state shown in FIG. 8 immediately prior to being attached to the pedestal shown in FIG. 10B.

FIG. 11 shows the state immediately prior to installing the neck 100 shown in FIG. 8 to the pedestal 200, secured to the washstand 400. This step of installing comprises securing the neck 100, and connecting a water supply thereto.

The neck 100 is secured by meshing the clawed leg sections 113*b* of the neck 100 into the spiraled grooves 201*b*of the ring-like blade section 201. As shown in FIG. 11, each spiraled groove 201*b* has a section which is diagonal to the top face of the ring-like blade section 201, and a parallel section which is provided at the tip of the diagonal section.

To mesh the clawed leg sections 113*b* into the spiraled grooves 201*b*, the bottom section of the neck 100 is aligned with the top face of the ring-like blade section 201, and a force is applied in the downward direction of FIG. 11 while rotating the neck 100 clockwise. As the angle of rotation deepens, the clawed leg sections 113*b* follow the spiraled grooves 201*b*, traveling from the diagonal section to the parallel section until the neck 100 stops rotating. Consequently, the neck 100 becomes secured to the pedestal 200.

On the other hand, when the neck 100 is attached, the connecting section 112*b* of the water-pass member 112 meshes with an unillustrated pipe-connecting member 202, and an 0-ring around the outer periphery of the connecting section 112*b* achieves a water-tight state.

An unillustrated water-supply pipe is connected to the bottom end of the pipe-connecting member 202 by using an appropriate connecting tool.

Figure 12:
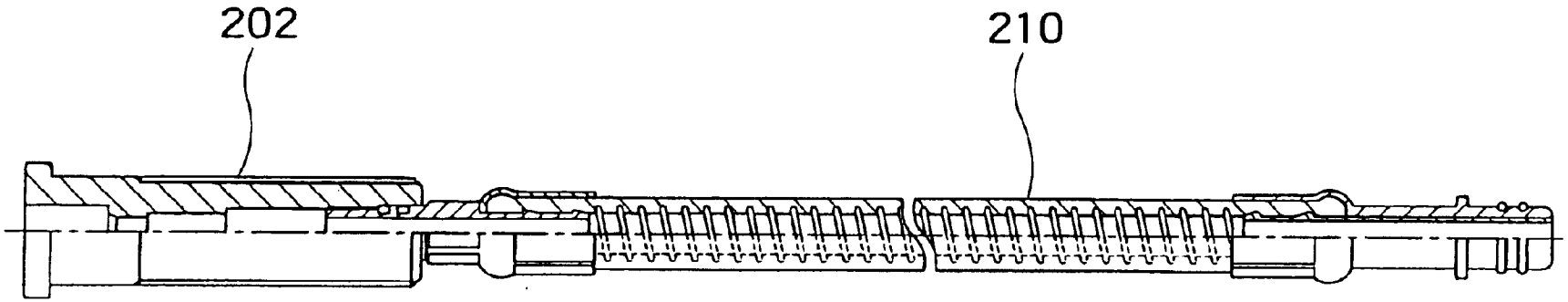
FIG. 12 shows a diagram showing the internal constitution of a pipe-connecting member 202 shown in FIGS. 9 to 11, and a connecting tool for connecting a water supply pipe to the pipe-connecting member.
Figure 13:
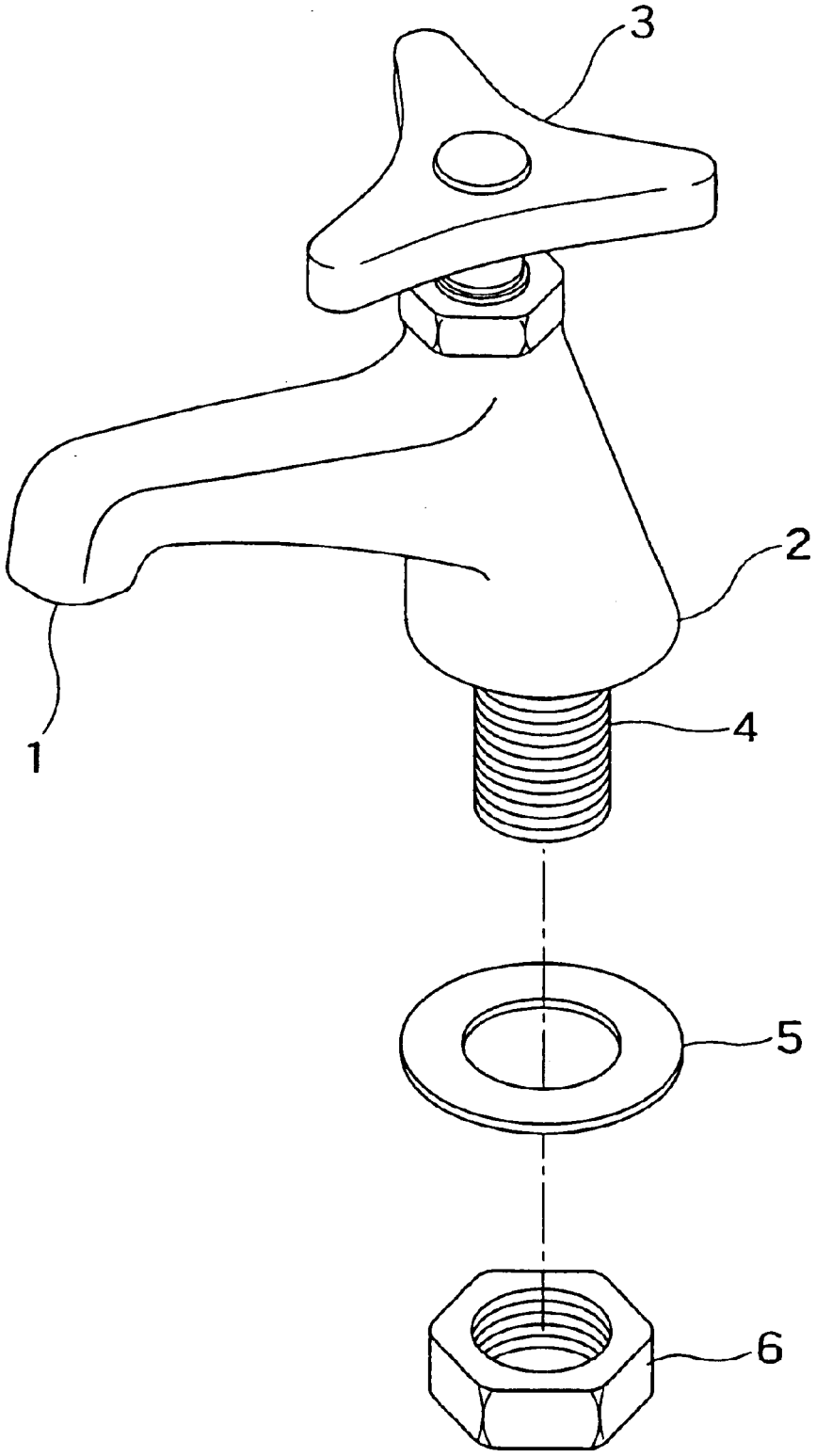
PRIOR ART FIG. 13
FIG. 13 shows the attachment structure of a conventional water lock.

FIG. 12 shows the internal constitution of the pipe-connecting member 202, and a connecting tool 210 for connecting the water-supply pipe thereto. The end of the pipe-connecting member 202 at the right side of FIG. 12 has a socket structure, and the end of the connecting tool 210 at the left of FIG. 12 has a corresponding socket structure, achieving a water-tight connection between the pipe-connecting member 202 and the connecting tool 210. The right end of the connecting tool 210 at the opposite end to the flexible tube has a similar socket structure, and can be connected to a water-supply pipe having a similar socket structure to the pipe-connecting member 202.

Modifications

The above embodiment describes a case where the water lock is attached to a washstand, but this invention can be similarly applied in other installations using a water lock.

Further, by changing the width, depth, and the like of the plurality of spiraled grooves in the above embodiment, it is possible to ensure that the neck can only be attached at a predetermined angle.

The above embodiment describes a neck with a screw structure, but any system which involves insertion and rotation, such as a bayonet structure, is suitable.

As described above, according to this invention, the pedestal and the pipe attachment member are attached from above the washstand, avoiding the conventional problem of installation in a place of poor workability, such as below the washstand, and making attachment easy and rapid.

Further, as described above, by providing the washstand and the like with a pedestal having spiraled grooves in its outer periphery, and providing a clawed member in the neck for meshing with the spiraled grooves, the neck can be attached and removed to/from the pedestal simply by being pressed and lightly rotated. Moreover, since the neck attachment structure in the pedestal is one wherein the neck is pressed against the pedestal while being slightly rotated so that the clawed member follows the spiraled grooves, there is no special need for a pedestal structure which prevents rotation.

What is claimed is:

1. A water lock tap comprising a pedestal, which is secured to an attachment object, a pipe attachment member for attaching a water supply pipe to the bottom of the pedestal, and a neck, which is secured to the pedestal;

the pedestal comprising a mesh structure for securing the neck to the outer periphery of the pedestal, and having a ring-like blade section which clips into an attachment hole, provided in the attachment object, and a cylindrical moving member which is suspended from the ring-like blade section and has a plurality of protruding members, which are pressed toward the outside when a cylindrical member having a screw notch in its outer periphery is screwed into a cylindrical space having a screw notch in its inner periphery, the cylindrical member having a slightly smaller diameter than the cylindrical space; and the pipe attachment member comprising a screw notch section which functions as the cylindrical member, a flange section which connects to the screw notch section and is accommodated in the ring-like blade section in the pedestal, and a join section which is connected to the water supply pipe.

2. The water lock tap as described in claim 1, the mesh structure comprising a screw groove for securing by screwing.

3. The water lock tap as described in claim 2, the screw groove in the pedestal comprising a plurality of grooves of different widths, such that the neck meshes only when screwed in at a predetermined angle.

4. The water lock tap as described in claim 1, the side faces of the protruding members of the pedestal being fan-shaped, supported with their primary sections as fulcrums so that they can sway freely, and arranged at equal intervals around the pedestal.

5. The water lock tap as described in claim 1, the pipe attachment member having a hole for wrench at the center of the flange section.

6. The water lock tap as described in claim 1, the pipe attachment member comprising a water-stop valve near an insertion section of the neck, the water-stop valve being opened by inserting the neck.

* * * * *